US007674300B2

(12) United States Patent
Janssen et al.

(10) Patent No.: US 7,674,300 B2
(45) Date of Patent: Mar. 9, 2010

(54) PROCESS FOR DYEING A TEXTILE WEB

(75) Inventors: Robert Allen Janssen, Alpharetta, GA (US); Thomas David Ehlert, Neenah, WI (US); John Gavin MacDonald, Decatur, GA (US); Earl C. McCraw, Jr., Duluth, GA (US); Patrick Sean McNichols, Hortonville, WI (US); Michael Joseph Garvey, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 56 days.

(21) Appl. No.: 11/647,534

(22) Filed: Dec. 28, 2006

(65) Prior Publication Data

US 2008/0155765 A1 Jul. 3, 2008

(51) Int. Cl.
*D06P 5/20* (2006.01)

(52) U.S. Cl. ..... 8/444

(58) Field of Classification Search ..... 8/115.51, 8/444

See application file for complete search history.

(56) References Cited

U.S. PATENT DOCUMENTS

| | | | |
|---|---|---|---|
| 2,904,981 | A | 9/1959 | Macomson |
| 3,202,281 | A | 8/1965 | Weston |
| 3,249,453 | A | 5/1966 | Schnoring et al. |
| 3,273,631 | A | 9/1966 | Neuman |
| 3,275,787 | A | 9/1966 | Newberry |
| 3,325,348 | A | 6/1967 | Bennett |
| 3,338,992 | A | 8/1967 | Kinney |
| 3,341,394 | A | 9/1967 | Kinney |
| 3,410,116 | A | 11/1968 | Levinson |
| 3,471,248 | A | 10/1969 | Schaeuble |
| 3,484,179 | A | 12/1969 | Adams et al. |
| 3,490,584 | A | 1/1970 | Balamuth |
| 3,502,763 | A | 3/1970 | Hartman |
| 3,519,517 | A | 7/1970 | Dench |
| 3,542,615 | A | 11/1970 | Dobo et al. |
| 3,584,389 | A | 6/1971 | Hilton et al. |
| 3,620,875 | A | 11/1971 | Guglielmo, Sr. et al. |
| 3,620,876 | A | 11/1971 | Guglielmo, Sr. et al. |
| 3,653,952 | A | 4/1972 | Gagliardi |
| 3,672,066 | A | 6/1972 | Stephansen |
| 3,673,140 | A | 6/1972 | Ackerman et al. |
| 3,692,618 | A | 9/1972 | Dorschner et al. |
| 3,707,773 | A | 1/1973 | Wolfberg et al. |
| 3,762,188 | A | 10/1973 | Bernholz et al. |
| 3,782,547 | A | 1/1974 | Dietert |
| 3,802,817 | A | 4/1974 | Matsuki et al. |
| 3,829,328 | A | 8/1974 | Blustain |
| 3,849,241 | A | 11/1974 | Butin et al. |
| 3,888,715 | A | 6/1975 | Fraser et al. |
| 3,902,414 | A | 9/1975 | Zimmer |
| 3,932,129 | A | 1/1976 | Porter |
| 4,046,073 | A | 9/1977 | Mitchell et al. |
| 4,060,438 | A | 11/1977 | Johnson |
| 4,062,768 | A | 12/1977 | Elliot |
| 4,086,112 | A | 4/1978 | Porter |
| 4,131,424 | A | 12/1978 | Cocoros |
| 4,156,626 | A | 5/1979 | Souder |
| 4,210,674 | A | 7/1980 | Mitchell |
| 4,234,775 | A | 11/1980 | Wolfberg et al. |
| 4,242,091 | A | 12/1980 | Feess et al. |
| 4,274,209 | A | 6/1981 | Kawaguchi |
| 4,302,485 | A | 11/1981 | Last et al. |
| 4,339,295 | A | 7/1982 | Boretos et al. |
| 4,340,563 | A | 7/1982 | Appel et al. |
| 4,365,422 | A | 12/1982 | Kawaguchi |
| 4,379,710 | A | 4/1983 | Crounse |
| 4,393,671 | A | 7/1983 | Ito |
| 4,413,069 | A | 11/1983 | Marshall |
| 4,419,160 | A * | 12/1983 | Wang et al. ..... 156/73.2 |
| 4,425,718 | A | 1/1984 | Kawaguchi |
| 4,482,239 | A | 11/1984 | Hosono et al. |

(Continued)

FOREIGN PATENT DOCUMENTS

| | | |
|---|---|---|
| DE | 2056104 | 5/1972 |

(Continued)

OTHER PUBLICATIONS

Birla, M., et al. "Continuous Dyeing of Cotton Using Ultrasound" AATCC Book of Papers, IC&E, 1996, pp. 309-322.*

(Continued)

*Primary Examiner*—Lorna M Douyon
*Assistant Examiner*—Amina Khan
(74) *Attorney, Agent, or Firm*—Armstrong Teasdale, LLP

(57) ABSTRACT

In a process for dyeing a textile web, dye is applied directly to a first face of the textile web other than by saturating the web. The web is moved in an open configuration thereof over a contact surface of an ultrasonic vibration system with a second (opposite) face of the textile web in direct contact with the contact surface of the ultrasonic vibration system and the first face free from contact with the contact surface of the ultrasonic vibration system. The ultrasonic vibration system is operated to impart ultrasonic energy to the second face of the textile web to facilitate movement of the dye from the first face of the web into and through the web to the second face thereof. In another embodiment, dye is applied to the first face of the textile web without applying the dye to the second face of the web.

32 Claims, 8 Drawing Sheets
(4 of 8 Drawing Sheet(s) Filed in Color)

U.S. PATENT DOCUMENTS

| | | | |
|---|---|---|---|
| 4,483,571 | A | 11/1984 | Mishiro |
| 4,494,956 | A | 1/1985 | Schafer et al. |
| 4,511,520 | A | 4/1985 | Bowen |
| 4,548,611 | A | 10/1985 | Paterson et al. |
| 4,602,055 | A | 7/1986 | Schafer et al. |
| 4,612,016 | A | 9/1986 | Jaeger et al. |
| 4,626,642 | A | 12/1986 | Wang et al. |
| 4,662,969 | A | 5/1987 | Wang |
| 4,673,512 | A | 6/1987 | Schram |
| 4,693,879 | A | 9/1987 | Yoshimura et al. |
| 4,706,509 | A | 11/1987 | Riebel |
| 4,707,402 | A | 11/1987 | Thorsrud |
| 4,708,878 | A | 11/1987 | Hagelauer et al. |
| 4,743,361 | A | 5/1988 | Schram |
| 4,751,529 | A | 6/1988 | Elrod et al. |
| 4,861,342 | A | 8/1989 | Danel |
| 4,877,516 | A | 10/1989 | Schram |
| 4,879,011 | A | 11/1989 | Schram |
| 4,879,564 | A | 11/1989 | Long |
| 4,906,497 | A | 3/1990 | Hellmann et al. |
| 4,929,279 | A | 5/1990 | Hays |
| 4,945,121 | A | 7/1990 | Micale et al. |
| 4,969,968 | A | 11/1990 | Leatherman |
| RE33,524 | E | 1/1991 | Schram |
| 4,991,539 | A | 2/1991 | Sarda |
| 4,992,636 | A | 2/1991 | Namiki |
| 5,002,587 | A | 3/1991 | Berendt |
| 5,006,266 | A | 4/1991 | Schram |
| 5,028,237 | A | 7/1991 | Berendt |
| 5,059,249 | A | 10/1991 | Hays |
| 5,169,571 | A | 12/1992 | Buckley |
| 5,171,387 | A | 12/1992 | Wuchinich |
| 5,189,078 | A | 2/1993 | Johnson et al. |
| 5,193,362 | A | 3/1993 | Otto |
| 5,193,913 | A | 3/1993 | Rosebaum |
| 5,217,768 | A | 6/1993 | Walters et al. |
| 5,220,346 | A | 6/1993 | Carreira et al. |
| 5,238,975 | A | 8/1993 | Johnson et al. |
| 5,242,557 | A | 9/1993 | Jones et al. |
| 5,244,525 | A | 9/1993 | Neuwirth et al. |
| 5,246,467 | A | 9/1993 | Cockett et al. |
| 5,272,216 | A | 12/1993 | Clark, Jr. et al. |
| 5,338,611 | A | 8/1994 | Lause et al. |
| 5,340,649 | A | 8/1994 | Roeker et al. |
| 5,346,932 | A | 9/1994 | Takahashi et al. |
| 5,368,199 | A | 11/1994 | Haas et al. |
| 5,400,460 | A | 3/1995 | Roeker et al. |
| 5,423,260 | A | 6/1995 | Goldberg et al. |
| 5,442,160 | A | 8/1995 | Kimrey, Jr. et al. |
| 5,446,270 | A | 8/1995 | Chamberlain et al. |
| 5,466,722 | A | 11/1995 | Stoffer et al. |
| 5,487,853 | A | 1/1996 | Buckley |
| 5,500,668 | A | 3/1996 | Malhotra et al. |
| 5,536,921 | A | 7/1996 | Hedrick et al. |
| 5,543,605 | A | 8/1996 | Kimrey, Jr. et al. |
| 5,563,644 | A | 10/1996 | Isganitis et al. |
| 5,603,795 | A | 2/1997 | Paulauskas et al. |
| 5,631,685 | A | 5/1997 | Gooray et al. |
| 5,652,019 | A | 7/1997 | Moran |
| 5,709,737 | A | 1/1998 | Malhotra et al. |
| 5,770,296 | A | 6/1998 | Remerowski et al. |
| 5,798,395 | A | 8/1998 | Lauf et al. |
| 5,803,270 | A | 9/1998 | Brodeur |
| 5,804,801 | A | 9/1998 | Lauf et al. |
| 5,814,138 | A | 9/1998 | Fague |
| 5,831,166 | A | 11/1998 | Kozuka et al. |
| 5,851,274 | A | 12/1998 | Lin |
| 5,853,469 | A | 12/1998 | Colt et al. |
| 5,856,245 | A | 1/1999 | Caldwell et al. |
| 5,871,872 | A | 2/1999 | Matijevic et al. |
| 5,902,489 | A | 5/1999 | Yasuda et al. |
| 5,913,904 | A | 6/1999 | Meyer et al. |
| 5,916,203 | A | 6/1999 | Brandon et al. |
| 5,979,664 | A | 11/1999 | Brodeur |
| 5,984,468 | A | 11/1999 | Malhotra |
| 5,989,475 | A | 11/1999 | Schulthess et al. |
| 6,007,662 | A | 12/1999 | Remerowski et al. |
| 6,019,921 | A | 2/2000 | Lutz |
| 6,024,822 | A | 2/2000 | Alper et al. |
| 6,045,648 | A | 4/2000 | Palmgren et al. |
| 6,055,859 | A | 5/2000 | Kozuka et al. |
| 6,074,466 | A | 6/2000 | Iwasa |
| 6,089,702 | A | 7/2000 | Hilton |
| 6,103,812 | A | 8/2000 | Wei et al. |
| 6,114,676 | A | 9/2000 | Jerby et al. |
| 6,117,192 | A | 9/2000 | Tate |
| 6,129,767 | A | 10/2000 | Hong |
| 6,203,151 | B1 | 3/2001 | Ruhe |
| 6,221,258 | B1 | 4/2001 | Feke et al. |
| 6,254,787 | B1 | 7/2001 | Kimura et al. |
| 6,266,836 | B1 | 7/2001 | Gallego Juarez et al. |
| 6,303,061 | B1 | 10/2001 | Hewins |
| 6,332,541 | B1 | 12/2001 | Coakley et al. |
| 6,348,679 | B1 | 2/2002 | Ryan et al. |
| 6,350,792 | B1 | 2/2002 | Smetana et al. |
| 6,368,994 | B1 | 4/2002 | Sklyarevich |
| 6,381,995 | B1 | 5/2002 | Hong |
| 6,409,329 | B1 | 6/2002 | King |
| 6,419,798 | B1 | 7/2002 | Topolkaraev et al. |
| 6,425,663 | B1 | 7/2002 | Eastlund et al. |
| 6,431,702 | B2 | 8/2002 | Ruhe |
| 6,436,513 | B1 | 8/2002 | Kitamura et al. |
| 6,444,964 | B1 | 9/2002 | Eastlund et al. |
| 6,457,823 | B1 | 10/2002 | Cleary et al. |
| 6,467,350 | B1 | 10/2002 | Kaduchak et al. |
| 6,508,550 | B1 | 1/2003 | Eastlund et al. |
| 6,578,959 | B1 | 6/2003 | Seccombe |
| 6,600,142 | B2 | 7/2003 | Ryan et al. |
| 6,605,651 | B1 | 8/2003 | Stangel |
| 6,646,026 | B2 | 11/2003 | Fan et al. |
| 6,649,888 | B2 | 11/2003 | Ryan et al. |
| 6,652,602 | B2 | 11/2003 | Yang et al. |
| 6,663,239 | B2 | 12/2003 | Wotton et al. |
| 6,673,178 | B2 | 1/2004 | Ellner et al. |
| 6,683,287 | B2 | 1/2004 | Behnke et al. |
| 6,686,573 | B2 | 2/2004 | Behnke et al. |
| 6,689,730 | B2 | 2/2004 | Hortel et al. |
| 6,719,422 | B2 | 4/2004 | Wu et al. |
| 6,734,409 | B1 | 5/2004 | Wang et al. |
| 6,783,623 | B2 | 8/2004 | Morin et al. |
| 6,822,135 | B2 | 11/2004 | Soerens et al. |
| 6,846,448 | B2 | 1/2005 | Rymer et al. |
| 6,855,760 | B1 | 2/2005 | Kirsten et al. |
| 6,866,378 | B2 | 3/2005 | Wotton et al. |
| 6,901,683 | B2 | 6/2005 | Lyle et al. |
| 6,902,650 | B2 | 6/2005 | Park et al. |
| 6,929,750 | B2 | 8/2005 | Laurell et al. |
| 6,938,683 | B2 | 9/2005 | Lyle et al. |
| 7,034,266 | B1 | 4/2006 | DeGroot et al. |
| 7,186,772 | B2 | 3/2007 | Berkau et al. |
| 2002/0074380 | A1 | 6/2002 | Ellner et al. |
| 2002/0079121 | A1 | 6/2002 | Ryan et al. |
| 2002/0133888 | A1 | 9/2002 | Boyes |
| 2002/0142106 | A1 | 10/2002 | Bethune et al. |
| 2003/0116888 | A1 | 6/2003 | Rymer et al. |
| 2003/0118814 | A1 | 6/2003 | Workman, Jr. et al. |
| 2003/0118825 | A1 | 6/2003 | Melius et al. |
| 2003/0119406 | A1 | 6/2003 | Abuto |
| 2004/0065599 | A1 | 4/2004 | Lal et al. |
| 2004/0130606 | A1 | 7/2004 | Tawaraya et al. |
| 2004/0179076 | A1 | 9/2004 | Cohen et al. |
| 2004/0222080 | A1 | 11/2004 | Tour et al. |
| 2004/0232583 | A1 | 11/2004 | Monsheimer et al. |
| 2005/0008560 | A1 | 1/2005 | Kataoka et al. |

| | | | |
|---|---|---|---|
| 2005/0082234 | A1 | 4/2005 | Solenthaler |
| 2005/0100812 | A1 | 5/2005 | Schultheis et al. |
| 2005/0132906 | A1 | 6/2005 | Fernfors et al. |
| 2005/0202578 | A1 | 9/2005 | Yaniv et al. |
| 2005/0235740 | A1 | 10/2005 | Desie et al. |
| 2005/0238804 | A1 | 10/2005 | Garbar et al. |
| 2008/0062811 | A1 | 3/2008 | Janssen et al. |
| 2008/0063718 | A1 | 3/2008 | Janssen et al. |
| 2008/0063806 | A1 | 3/2008 | Janssen et al. |
| 2008/0155762 | A1 | 7/2008 | Janssen et al. |
| 2008/0155763 | A1 | 7/2008 | Janssen et al. |
| 2008/0156428 | A1 | 7/2008 | Janssen et al. |

FOREIGN PATENT DOCUMENTS

| | | | |
|---|---|---|---|
| DE | 3325958 | | 2/1985 |
| DE | 4344455 | | 6/1995 |
| DE | 19703634 | | 10/1997 |
| DE | 29923223 | | 7/2000 |
| DE | 19911683 | | 9/2000 |
| DE | 19913179 | | 9/2000 |
| DE | 10245201 | | 4/2004 |
| DE | 10353804 | | 6/2005 |
| EP | 0003684 | B1 | 8/1979 |
| EP | 0031862 | B1 | 7/1981 |
| EP | 0041779 | A1 | 12/1981 |
| EP | 0063203 | A1 | 10/1982 |
| EP | 0065057 | A1 | 11/1982 |
| EP | 0065058 | A1 | 11/1982 |
| EP | 0141556 | A2 | 5/1985 |
| EP | 0170758 | A1 | 2/1986 |
| EP | 0188105 | A1 | 7/1986 |
| EP | 0212655 | | 3/1987 |
| EP | 0281041 | B1 | 9/1988 |
| EP | 0303803 | B1 | 2/1989 |
| EP | 0455265 | | 11/1991 |
| EP | 0625606 | B1 | 11/1991 |
| EP | 0459967 | | 12/1991 |
| EP | 0549542 | A1 | 6/1993 |
| EP | 0282015 | B1 | 6/1995 |
| EP | 0667245 | A1 | 8/1995 |
| EP | 0798116 | A1 | 10/1997 |
| EP | 0907423 | | 4/1999 |
| EP | 0969131 | B1 | 1/2000 |
| EP | 0984045 | | 3/2000 |
| EP | 0984045 | B1 | 3/2000 |
| EP | 1010796 | | 6/2000 |
| EP | 1010796 | B1 | 6/2000 |
| EP | 1029651 | | 8/2000 |
| EP | 1238034 | B1 | 12/2003 |
| EP | 1371697 | A2 | 12/2003 |
| EP | 1396316 | | 3/2004 |
| EP | 1541322 | A2 | 6/2005 |
| FR | 2175286 | | 10/1973 |
| FR | 2878536 | | 6/2006 |
| GB | 631882 | | 11/1949 |
| GB | 850365 | | 10/1960 |
| GB | 1124787 | | 8/1968 |
| GB | 1229200 | A | 4/1971 |
| GB | 1257807 | A | 12/1971 |
| GB | 1363277 | A | 8/1974 |
| GB | 1404575 | | 9/1975 |
| GB | 1466735 | | 3/1977 |
| GB | 1482755 | A | 8/1977 |
| GB | 1583953 | A | 2/1981 |
| GB | 2120497 | | 11/1983 |
| GB | 2350321 | A | 11/2000 |
| JP | 5468842 | A | 6/1979 |
| JP | 55107490 | A | 8/1980 |
| JP | 56028221 | | 3/1981 |
| JP | 57119853 | | 7/1982 |
| JP | 58034051 | | 2/1983 |
| JP | 59171682 | A | 9/1984 |
| JP | 60101090 | A | 6/1985 |
| JP | 61291190 | A | 12/1986 |
| JP | 63072364 | | 4/1988 |
| JP | 63104664 | | 5/1988 |
| JP | 63318438 | A | 12/1988 |
| JP | 1108081 | | 4/1989 |
| JP | 1163074 | A | 6/1989 |
| JP | 01213458 | | 8/1989 |
| JP | 1213486 | A | 8/1989 |
| JP | 2025602 | | 1/1990 |
| JP | 2167700 | A | 6/1990 |
| JP | 2220812 | A | 9/1990 |
| JP | 2262178 | A | 10/1990 |
| JP | 336034 | A | 2/1991 |
| JP | 3086258 | | 4/1991 |
| JP | 3099883 | A | 4/1991 |
| JP | 3137283 | A | 6/1991 |
| JP | 3244594 | A | 10/1991 |
| JP | 04257445 | | 9/1992 |
| JP | 4257445 | A | 9/1992 |
| JP | 6228824 | | 8/1994 |
| JP | 7198257 | A | 8/1995 |
| JP | 7314661 | A | 12/1995 |
| JP | 8304388 | | 11/1996 |
| JP | 9286943 | | 11/1997 |
| JP | 10060331 | | 3/1998 |
| JP | 10112384 | A | 4/1998 |
| JP | 10112385 | A | 4/1998 |
| JP | 10112386 | A | 4/1998 |
| JP | 10112387 | A | 4/1998 |
| JP | 10315336 | A | 12/1998 |
| JP | 11034590 | A | 2/1999 |
| JP | 11133661 | | 5/1999 |
| JP | 2000144582 | A | 5/2000 |
| JP | 2000158364 | | 6/2000 |
| JP | 2001228733 | A | 8/2001 |
| JP | 2001252588 | | 9/2001 |
| JP | 2002210920 | A | 7/2002 |
| JP | 2004020176 | | 1/2004 |
| JP | 2004082530 | | 3/2004 |
| JP | 2004238012 | A | 8/2004 |
| JP | 2004256783 | | 9/2004 |
| JP | 2005118688 | | 5/2005 |
| WO | 8910258 | | 11/1989 |
| WO | 9117889 | | 11/1991 |
| WO | 9420833 | | 9/1994 |
| WO | 9620784 | | 7/1996 |
| WO | 199628599 | | 9/1996 |
| WO | 9743026 | | 11/1997 |
| WO | 9817373 | | 4/1998 |
| WO | 199822250 | | 5/1998 |
| WO | 9844058 | | 10/1998 |
| WO | 9961539 | | 12/1999 |
| WO | 0004978 | | 2/2000 |
| WO | 0026011 | | 5/2000 |
| WO | 0026026 | | 5/2000 |
| WO | 0029178 | | 5/2000 |
| WO | 0031189 | | 6/2000 |
| WO | 0041794 | | 7/2000 |
| WO | 0109262 | | 2/2001 |
| WO | 0110635 | | 2/2001 |
| WO | 0121725 | | 3/2001 |
| WO | 0136116 | | 5/2001 |
| WO | 0136117 | | 5/2001 |
| WO | 0250511 | | 6/2002 |
| WO | 02062894 | | 8/2002 |
| WO | 02064354 | | 8/2002 |
| WO | 03016030 | | 2/2003 |
| WO | 03102737 | | 12/2003 |
| WO | 03106143 | | 12/2003 |
| WO | 03106573 | | 12/2003 |
| WO | 03106600 | | 12/2003 |
| WO | 2004011044 | | 2/2004 |

| | | | |
|---|---|---|---|
| WO | 2004037902 | | 5/2004 |
| WO | 2004048463 | | 6/2004 |
| WO | 2004050350 | | 6/2004 |
| WO | 2004063295 | | 7/2004 |
| WO | 2004076578 | | 9/2004 |
| WO | 2004091841 | | 10/2004 |
| WO | 2004092048 | | 10/2004 |
| WO | 2005028577 | | 3/2005 |
| WO | 2005073329 | | 8/2005 |
| WO | 2005080066 | | 9/2005 |
| WO | 2006004765 | | 1/2006 |
| WO | 2006055038 | | 5/2006 |
| WO | 2006074921 | | 7/2006 |
| WO | 2006074921 | A1 | 7/2006 |
| WO | WO 2006/074921 | * | 7/2006 |

OTHER PUBLICATIONS

"Ultrasonics sound technology for textiles and nonwovens" ExpressTextile, issue dated Aug. 21, 2003, 5 pages.*

Vajnhandl, S., et al. "Ultrasound in textile dyeing and the decolouration/mineralization of textile dyes" Dyes and Pigments. (2005), 65, pp. 89-101.*

International Search Report and Written Opinion regarding PCT/IB2007/054890, dated Apr. 18, 2008.

U.S. Appl. No. 11/530,183, filed Sep. 8, 2006, Robert Allen Janssen.

U.S. Appl. No. 11/617,417, filed Dec. 28, 2006.

U.S. Appl. No. 11/777,116, filed Jul. 12, 2007.

U.S. Appl. No. 11/617,405, filed Dec. 28, 2006.

U.S. Appl. No. 11/777,124, filed Jul. 12, 2007.

U.S. Appl. No. 11/646,816, filed Dec. 28, 2006.

U.S. Appl. No. 11/617,473, filed Dec. 28, 2006.

U.S. Appl. No. 11/777,128, filed Jul. 12, 2007.

U.S. Appl. No. 11/617,423, filed Dec. 28, 2006.

U.S. Appl. No. 11/965,435, filed Dec. 27, 2006.

International Search Report and Written Opinion from PCT/IB2007/054903 dated Apr. 17, 2008.

International Search Report and Written Opinion regarding PCT/IB2007/054897, dated Apr. 16, 2008.

International Search Report and Written Opinion regarding PCT/IB2007/054889, dated Apr. 16, 2008.

International Search Report and Written Opinion regarding PCT/IB2007/054905 dated May 6, 2008.

International Search Report and Written Opinion regarding PCT/IB2007/054909 dated May 8, 2008.

Birla, M., et al. "Continuous Dyeing of Cotton Using Ultrasound" AATCC Book of Papers, IC&E, 1996, pp. 309-322.

Mathur, M. R., et al. "Energy Conservation in Wet Processing: Development of Low Energy Dyeing Machine." Colourage Annual. 2004. pp. 93-99.

"Ultrasonics Sound Technology for Textiles and Nonwovens" Express Textile, Issue Dated Aug. 21, 2003, 5 pages.

Vajnhandl, S., et al. "Ultrasound in Textile Dyeing and the Decolouration/Mineralization of Textile Dyes" Dyes and Pigments. (2005), 65, pp. 89-101.

Office Action regarding U.S. Appl. No. 11/617,523, dated May 29, 2008.

Office Action regarding U.S. Appl. No. 11/646,816, dated May 30, 2008.

Final office action regarding U.S. Appl. No. 11/617,523, dated Nov. 17, 2008.

Non-final office action regarding U.S. Appl. No. 11/646,816, dated Dec. 15, 2008.

Non-final Office Action, U.S. Appl. No. 11/617,405, (Feb. 3, 2009).

Non-final Office Action, U.S. Appl. No. 11/617,417 (Mar. 9, 2009).

Non-final Office Action, U.S. Appl. No. 11/777,124 (Apr. 20, 2009).

Non-final Office Action regarding U.S. Appl. No. 11/617,473, dated Jun. 2, 2009.

Non-Final Office Action Regarding U.S. Appl. No. 11/646,816, dated Jun. 26, 2009.

Cohen, "The Importance of Viscosity in the Web Coating Process," Web Coating Blog, pp. 1-4 (Mar. 28, 2006).

Final Office Action, U.S. Appl. No. 11/617,405 (Jul. 31, 2009).

International Search Report and Written Opinion regarding PCT/IB2008/055396, dated Jul. 29, 2009.

Non-final Office action received in U.S. Appl. No. 11/777,128, mailed Jul. 21, 2009.

* cited by examiner

ULTRASOUND NO ULTRASOUND

ULTRASOUND NO ULTRASOUND

PROCESS FOR DYEING A TEXTILE WEB

FIELD OF INVENTION

This invention relates generally to processes for dyeing textile webs, and more particularly to a process for dyeing a textile web in which ultrasonic energy is used to facilitate the dyeing process.

BACKGROUND

The dyeing of textile webs is commonly achieved in one of two manners, the first being immersing the textile web into a bath of dye solution so that the dye soaks into the textile web and the second being applying dye to (e.g., by spraying or coating) one or both faces of the textile web. Immersion (also commonly referred to as a dip-coating process) of the textile web requires a substantial amount of dye solution to be used to saturate the textile web. In addition, following saturation the textile web must be washed to remove a substantial amount of unbound dye from the web. While dip-coating results in good penetration of the dye throughout the entire textile web, it presents a relatively inefficient use of the dye solution and requires considerable post-processing of the web.

Dye may instead be applied to one or both faces of the textile web by any number of application techniques including, without limitation, ink jet systems, spray systems, gravure roll, slot die, rod coater, rotary screen curtain coater, air knife, brush and the like. Following the application of dye to the web, the web is often heated and/or steamed to promote binding of the dye to the textile web. The textile web may then be washed, such as in a bath of water or other cleaning solution, to remove unbound and excess dye from the web.

Applying dye to the textile web in this manner (e.g., as opposed to dip-coating) requires considerably less dye to be initially applied to the web, and thus reduces the time spent heating/steaming the web to facilitate binding of the dye to the web, and also reduces the amount of unbound dye that needs to be subsequently washed from the web. Such dyeing operations where the dye is applied to only one face of the textile generally use less dye, but run the associated risk that dye does not adequately penetrate into and through the web to the opposite face to provide even or uniform coloring of the web. While dyeing both faces of the textile web somewhat reduces this risk it also requires additional dye to be used, resulting in more unbound dye that must be subsequently removed from the web.

There is a need, therefore, for a dyeing process that reduces the amount of dye that needs to be used in dyeing a textile web and facilitates improved penetration of the dye into and through the web during processing.

SUMMARY

A process according to one embodiment for dyeing a textile web having a first face and a second face opposite the first face generally comprises applying dye directly to the first face of the textile web other than by saturating the web. The web is moved in an open configuration thereof over a contact surface of an ultrasonic vibration system with the second face of the textile web in direct contact with the contact surface of the ultrasonic vibration system and the first face being free from contact with the contact surface of the ultrasonic vibration system. The ultrasonic vibration system is operated to impart ultrasonic energy to the second face of the textile web to facilitate movement of the dye from the first face of the web into and through the web to the second face thereof.

In another embodiment, a process for dyeing a textile web generally comprises moving a textile web having a first face and a second face opposite the first face past a dye applicating device. The dye applicating device is operated to apply dye to the first face of the textile web without applying the dye to the second face of the textile web. The dyed textile web is then moved in an open configuration thereof over a contact surface of an ultrasonic vibration system with the second face of the textile web in direct contact with the contact surface of the ultrasonic vibration system and the first face being free from contact with the contact surface of the ultrasonic vibration system. The ultrasonic vibration system is operated to impart ultrasonic energy to the second face of the textile web to facilitate movement of the dye from the first face of the web into and through the web to the second face thereof.

BRIEF DESCRIPTION OF THE DRAWINGS

The patent or application file contains at least one drawing executed in color. Copies of this patent or patent application publication with color drawing(s) will be provided by the U.S. Patent and Trademark Office upon request and payment of the necessary fee.

Corresponding reference characters indicate corresponding parts throughout the drawings.

DETAILED DESCRIPTION

Figure 1:
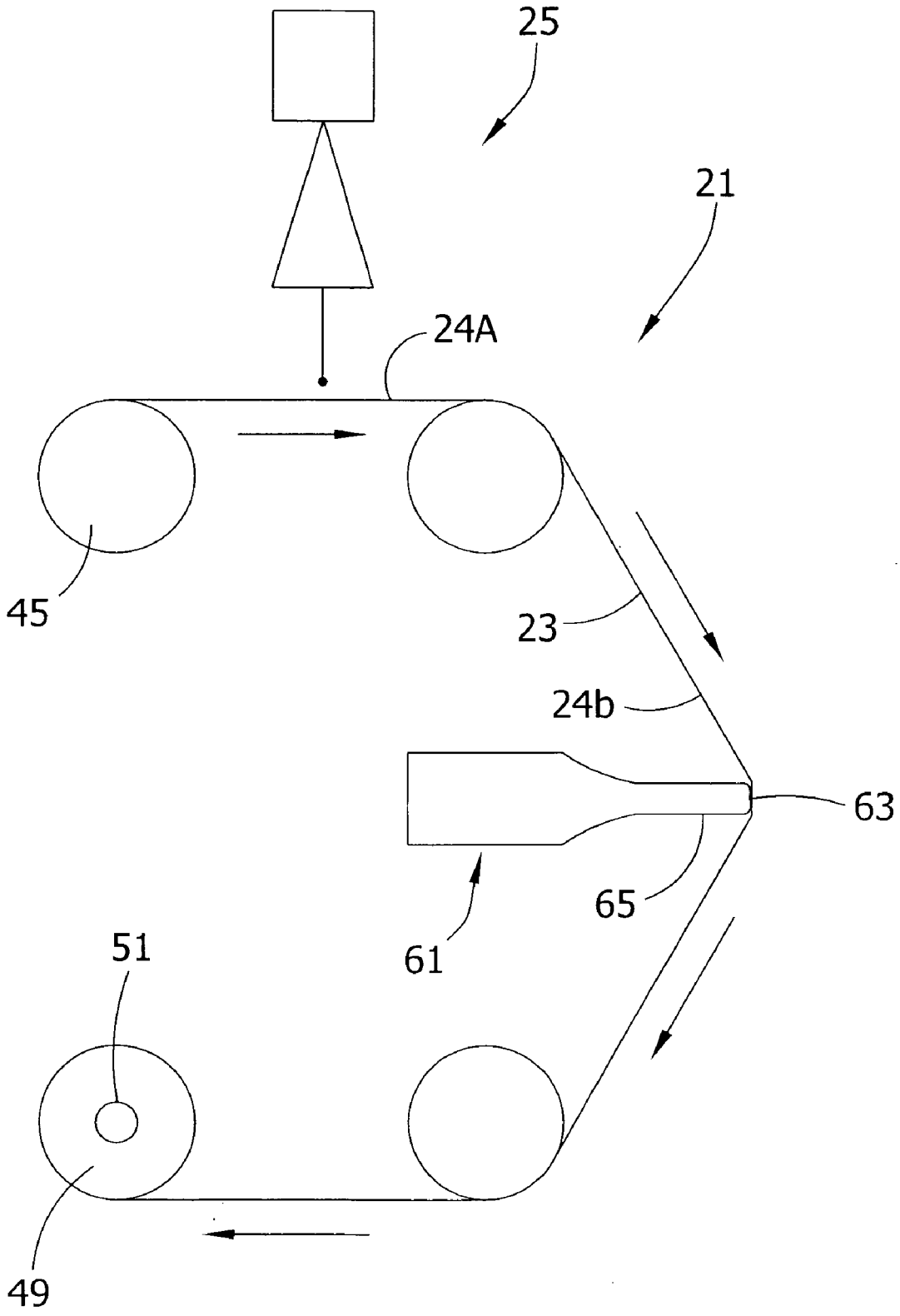
FIG. 1 is a schematic of one embodiment of apparatus for dyeing a textile web according to one embodiment of a process for dyeing a textile web.

With reference now to the drawings and in particular to FIG. 1, one embodiment of apparatus for use in dyeing a textile web 23 is generally designated 21. In one suitable embodiment, the textile web 23 to be processed by the apparatus 21 is suitably a woven web, but may also be a non-woven web, including without limitation bonded-carded webs, spunbond webs and meltblown webs, polyesters, polyolefins, cotton, nylon, silks, hydroknit, coform, nanofiber, fluff batting, foam, elastomerics, rubber, film laminates, combinations of these materials or other suitable materials. The textile web 23 may be a single web layer or a multilayer laminate in which one or more layers of the laminate are suitable for being dyed.

The term "spunbond" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat.

No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 20 microns.

The term "meltblown" refers to fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

Laminates of spunbond and meltblown fibers may be made, for example, by sequentially depositing onto a moving forming belt first a spunbond web layer, then a meltblown web layer and last another spunbond web layer and then bonding the layers together. Alternatively, the web layers may be made individually, collected in rolls, and combined in a separate bonding step. Such laminates usually have a basis weight of from about 0.1 to 12 osy (6 to 400 gsm), or more particularly from about 0.75 to about 3 osy.

More suitably, the textile web 23 is sufficiently open or porous so that dye applied to the web may migrate throughout the thickness of the web. The "porosity" of the textile web 23 is a measurement of the void space within the textile and is measured for a particular web specimen in the following manner. For a given length (in centimeters) and width (in centimeters) of a web specimen (e.g., over which the web is generally homogeneous and, as such, has a uniform specific gravity), the specimen is weighed (in grams) by a suitable balance and the thickness (in centimeters) is measured using a suitable device, such as a VIR Electronic Thickness Tester, Model Number 89-1-AB commercially available from Thwing-Albert Instrument Company of Philadelphia, Pa., U.S.A. A total volume (in cubic centimeters) of the web specimen is determined as length×width×thickness. A material volume (in cubic centimeters) of the web specimen (i.e., the volume taken up just by the material in the web specimen) is determined as the weight of the web specimen divided by the specific gravity (in grams/cubic centimeter) of the material from which the web is constructed. The porosity (in percent) of the web specimen is then determined as ((total volume−material volume)/total volume)×100.

In particularly suitable embodiments, the textile web 23 has a porosity of at least about 10 percent, and more suitably at least about 20 percent. In other embodiments the porosity as determined by the Porosity Test may be at least about 50 and in others the porosity may be at least about 75. More suitably, the porosity is in the range of about 10 percent to about 90 percent, and more suitably in the range of about 20 percent to about 90 percent.

Some non-limiting examples of suitable textile webs include a cotton fabric commercially available from Springs Global of Ft. Mill, S.C., U.S.A. as Spring Global Muslin CPG W/O—SKU 743006050371 (having a basis weight of about 105 grams/square meter (gsm)); a polyester fabric commercially available from John Boyle & Company of Statesville, N.C., U.S.A. as Main Street Fabrics—European Fashion PP—SKU 1713874 (having a basis weight of about 61 gsm); and a spunbond non-woven web commercially available from Pegas Nonwovens S.R.O. of Znojmo, Czech Republic as 23 gsm Pegas PP Liner necked to a basis weight of about 42 gsm. As a contrasting example, one unsuitable web material is paper, such as ink jet paper, and in particular ink jet paper commercially available as RSA Premium Inkjet Paper IJC2436300—24 pound (having a basis weight of about 92.4 gsm). The following table provides the porosity for each of these web materials, as determined by using the above measurement technique on four 7.5 cm×7.5 cm web specimens for each material and averaging the data.

| | weight (grams) | thickness (cm) | specific gravity (g/cc) | total volume (cc) | material volume (cc) | pore volume (cc) | porosity (percent) |
|---|---|---|---|---|---|---|---|
| Cotton fabric | 0.59 | 0.0288 | 1.490 | 1.62 | 0.39 | 1.23 | 76 |
| Polyester fabric | 0.35 | 0.0140 | 0.930 | 0.79 | 0.38 | 0.41 | 52 |
| Spunbond non-woven | 0.25 | 0.0350 | 0.900 | 1.97 | 0.28 | 1.70 | 86 |
| Inkjet paper | 0.52 | 0.0098 | 0.929 | 0.55 | 0.55 | 0.00 | 0 |

The dyeing apparatus 21 comprises a dye applicating device (schematically illustrated in FIG. 1 and generally indicated at 25) operable to apply dye to at least one of the faces 24*a*, 24*b* of the textile web 23. For example, in one particularly suitable embodiment the dye applicating device is particularly operable to apply dye to only one face 24*a* of the textile web. It is understood, however, that the applicating device 25 may be operable to apply dye only to the opposite face 24*b* of the textile web 23, or to both faces 24*a*, 24*b* of the web. It is also contemplated that more than one applicating device 25 may be used (e.g., one corresponding to each face 24*a*, 24*b* of the textile web 23) to apply ink to both faces of the textile web either concurrently or sequentially.

The term "dye" as used herein refers to a substance that imparts more or less permanent color to other materials, such as to the textile web 23. Suitable dyes include, without limitation, inks, lakes (also often referred to as color lakes), dyestuffs (for example but not limited to acid dyes, azoic dyes, basic dyes, direct dyes, disperse dyes, food, drug and cosmetic dyes (FD&C), drug and cosmetic dyes (D&C), ingrain dyes, leather dyes, mordant dyes, natural dyes, reactive dyes, solvent dyes sulfur dyes and vat dyes), pigments (organic and inorganic) and other colorants (for example but not limited to fluorescent brighteners, developers, oxidation bases). The dye is suitably a solvent-based dye (e.g., comprising water or an organic solvent). The dye suitably has a viscosity in the range of about 2 to about 100 centipoises, more suitably in the range of about 2 to about 20 centipoises, and even more suitably in the range of about 2 to about 10 centipoises to facilitate flow of the dye into and throughout the web.

The dye applicating device 25 according to one embodiment may comprise any suitable device used for applying dye to textile webs 23 other than by saturating the entire web (e.g., by immersing the textile web in a bath of dye solution to saturate the web), whether the dye is pre-metered (e.g., in which little or no excess dye is applied to the web upon initial application of the dye) or post-metered (i.e., an excess amount of dye is applied to the textile web and subsequently removed). It is understood that the dye itself may be applied to the textile web 23 or the dye may be used in a dye solution that is applied to the web.

Examples of suitable pre-metered dye applicating devices include, without limitation, devices for carrying out the following known applicating techniques:

Slot die: The dye is metered through a slot in a printing head directly onto the textile web 23.

Direct gravure: The dye is in small cells in a gravure roll. The textile web 23 comes into direct contact with the gravure roll and the dye in the cells is transferred onto the textile web.

Offset gravure with reverse roll transfer: Similar to the direct gravure technique except the gravure roll transfers the coating material to a second roll. This second roll then comes into contact with the textile web 23 to transfer dye onto the textile web.

Curtain coating: This is a coating head with multiple slots in it. Dye is metered through these slots and drops a given distance down onto the textile web 23.

Slide (Cascade) coating: A technique similar to curtain coating except the multiple layers of dye come into direct contact with the textile web 23 upon exiting the coating head. There is no open gap between the coating head and the textile web 23.

Forward and reverse roll coating (also known as transfer roll coating): This consists of a stack of rolls which transfers the dye from one roll to the next for metering purposes. The final roll comes into contact with the textile web 23. The moving direction of the textile web 23 and the rotation of the final roll determine whether the process is a forward process or a reverse process.

Extrusion coating: This technique is similar to the slot die technique except that the dye is a solid at room temperature. The dye is heated to melting temperature in the print head and metered as a liquid through the slot directly onto the textile web 23. Upon cooling, the dye becomes a solid again.

Rotary screen: The dye is pumped into a roll which has a screen surface. A blade inside the roll forces the dye out through the screen for transfer onto the textile.

Spray nozzle application: The dye is forced through a spray nozzle directly onto the textile web 23. The desired amount (pre-metered) of dye can be applied, or the textile web 23 may be saturated by the spraying nozzle and then the excess dye can be squeezed out (post-metered) by passing the textile web through a nip roller.

Flexographic printing: The dye is transferred onto a raised patterned surface of a roll. This patterned roll then contacts the textile web 23 to transfer the dye onto the textile.

Digital textile printing: The dye is loaded in an ink jet cartridge and jetted onto the textile web 23 as the textile web passes under the ink jet head.

Examples of suitable post-metering dye applicating devices for applying the dye to the textile web 23 include without limitation devices that operate according to the following known applicating techniques:

Rod coating: The dye is applied to the surface of the textile web 23 and excess dye is removed by a rod. A Mayer rod is the prevalent device for metering off the excess dye.

Air knife coating: The dye is applied to the surface of the textile web 23 and excess dye is removed by blowing it off using a stream of high pressure air.

Knife coating: The dye is applied to the surface of the textile web 23 and excess dye is removed by a head in the form of a knife.

Blade coating: The dye is applied to the surface of the textile web 23 and excess dye is removed by a head in the form of a flat blade.

Spin coating: The textile web 23 is rotated at high speed and excess dye applied to the rotating textile web spins off the surface of the web.

Fountain coating: The dye is applied to the textile web 23 by a flooded fountain head and excess material is removed by a blade.

Brush application: The dye is applied to the textile web 23 by a brush and excess material is regulated by the movement of the brush across the surface of the web.

Following the application of dye to the textile web 23, the textile web is suitably delivered to an ultrasonic vibration system, generally indicated at 61, having a contact surface 63 (FIG. 2) over which the dyed web 23 passes in contact with the vibration system such that the vibration system imparts ultrasonic energy to the web. In the illustrated embodiment, the ultrasonic vibration system 61 has a terminal end 65, at least a portion of which defines the contact surface 63 contacted by the textile web 23

Figure 2:
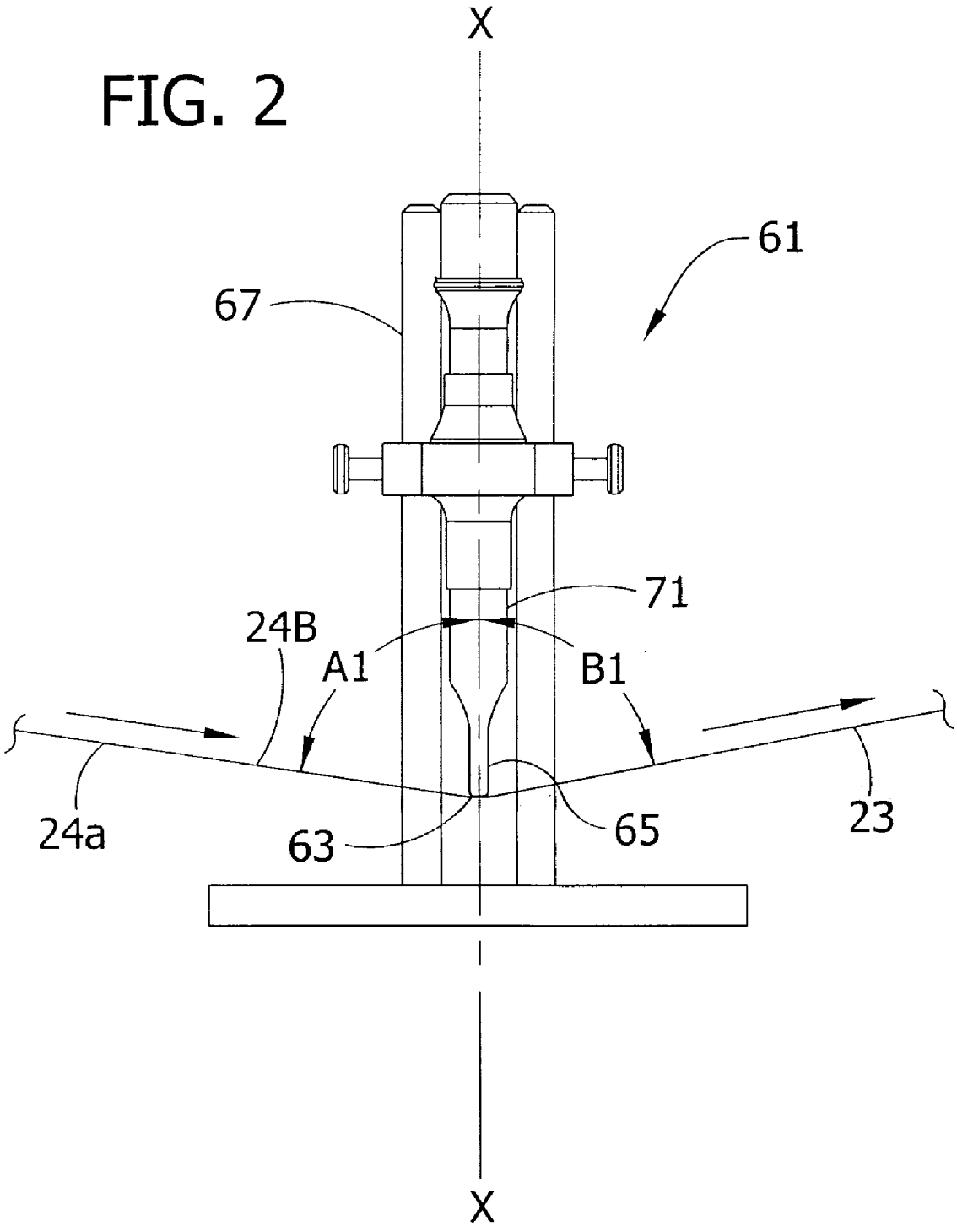
FIG. 2 is a side elevation of an ultrasonic vibration system and support frame of the apparatus of FIG. 1.

In one particularly suitable embodiment, the textile web 23 is suitably in the form of a generally continuous web, and more particularly a rolled web wherein the web is unrolled during processing and then rolled up following processing for transport to other post-processing stations. For example, as illustrated in FIGS. 1 and 2, the ultrasonic vibration system 61 may be suitably mounted on a support frame 67 (FIG. 2) intermediate an unwind roll 45 and a wind roll 49 (the unwind roll and wind roll also being mounted on suitable respective support frames (not shown)). It is understood, however, that the textile web 23 may alternatively be in the form of one or more discrete webs during treatment without departing from the scope of this invention. The dye applicating device 25 is located between the unwind roll 45 and the ultrasonic vibration system to apply dye to the one face 24*a* of the textile web before the web advances to the vibration system. It is understood, however, that dye may be applied to the textile web 23 other than immediately upstream of the ultrasonic vibration system, such as at a station that is entirely separate from that at which the web is ultrasonically treated, without departing from the scope of this invention.

The textile web 23 is suitably advanced (i.e., moved), such as by a suitable drive mechanism 51 (FIG. 1) at the wind roll 49, in a machine direction (indicated by the direction arrows in FIGS. 1 and 2) from the unwind roll past the dye applicating device 25 and the ultrasonic vibration system 61 to the wind roll. The term "machine direction" as used herein refers generally to the direction in which the textile web 23 is moved (e.g., longitudinally of the web in the illustrated embodiment) during processing. The term "cross-machine direction" is used herein to refer to the direction normal to the machine direction of the textile web 23 and generally in the plane of the web (e.g., widthwise of the web in the illustrated embodiment). With particular reference to FIG. 2, the textile web 23 suitably advances toward the contact surface 63 (e.g., at the terminal end 65 of the ultrasonic vibration system 61) at an approach angle A1 relative to a longitudinal axis X of the ultrasonic vibration system 61, and after passing over the contact surface the web further advances away from the contact surface at a departure angle B1 relative to the longitudinal axis X of the ultrasonic vibration system.

The approach angle A1 of the textile web 23, in one embodiment, is suitably in the range of about 1 to about 89 degrees, more suitably in the range of about 1 to about 45 degrees, and even more suitably in the range of about 10 to about 45 degrees. The departure angle B1 of the web 23 is suitably approximately equal to the approach angle A1 as illustrated in FIG. 2. However, it is understood that the departure angle B1 may be greater than or less than the approach angle A1 without departing from the scope of this invention.

In one particularly suitable embodiment, the ultrasonic vibration system 61 is adjustably mounted on the support frame 67 for movement relative to the support frame (e.g., vertically in the embodiment illustrated in FIG. 2) and the unwind and wind rolls 45, 49 to permit adjustment of the contact surface 63 of the ultrasonic vibration system relative to the web 23 to be treated. For example, the ultrasonic vibration system 61 is selectively positionable between a first position (not shown) at which the approach angle A1 and departure angle B1 of the web is substantially zero or at least relatively small, and a second position illustrated in FIGS. 1 and 2. In the first position of the vibration system 61, the contact surface 63 of the vibration system may but need not necessarily be in contact with the textile web 23.

In the second, or operating position of the ultrasonic vibration system 61, the terminal end 65 (and hence the contact surface 63) of the vibration system is substantially spaced from the first position and is in contact with the textile web 23. Movement of the vibration system 61 from its first position to its second position in this embodiment urges the web 23 to along with the contact surface 63 so as to form the approach and departure angles A1, B1 of the web.

Moving the ultrasonic vibration system 61 from its first position to its second position in this manner may also serve to tension, or increase the tension in, the textile web 23 at least along the segment of the web that lies against the contact surface 63 of the vibration system while the web is held between the unwind roll 45 and the wind roll 49. For example, in one embodiment the textile web 23 may be held in uniform tension along its width (i.e., its cross-machine direction dimension), at least at that segment of the web that is contacted by the contact surface 63 of the ultrasonic vibration system 61, in the range of about 0.025 pounds/inch of web width to about 3 pounds/inch of web width, and more suitably in the range of about 0.1 to about 1.25 pounds/inch of web width.

In one particularly suitable embodiment, the ultrasonic vibration system 61 is particularly located relative to the textile web 23 so that the contact surface 63 of the vibration system contacts the face 24*b* of the web opposite the face 24*a* to which the dye was initially applied. While in the illustrated embodiment the dye is applied to the one face 24*a* of the textile web while the ultrasonic vibration system 61 contacts the opposite face 24*b*, it is understood that the dye may instead be applied to the face 24*b* while the ultrasonic vibration system contacts the opposite face 24*a*.

Figure 3:
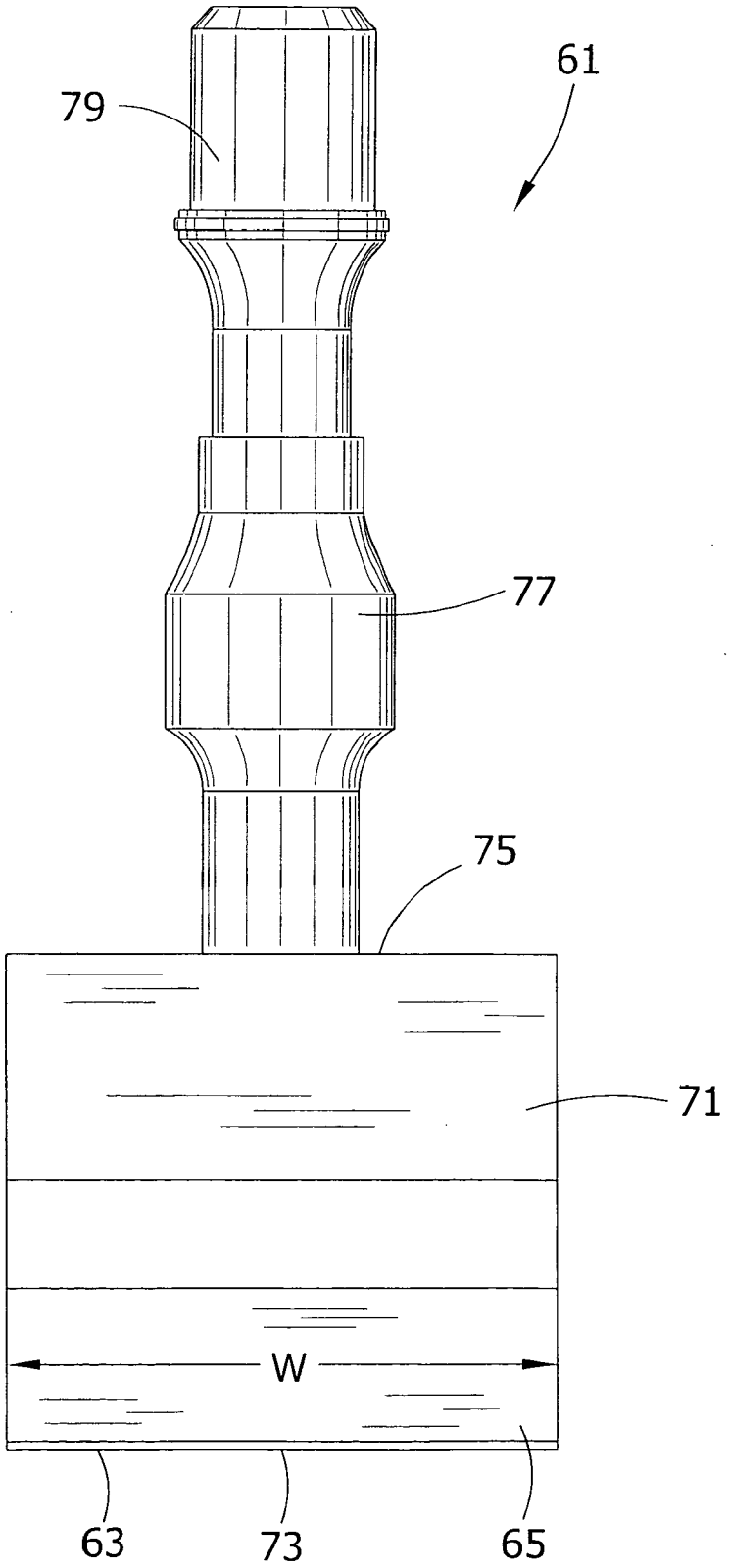
FIG. 3 is a front elevation of the ultrasonic vibration system of the apparatus of FIG. 1.

With particular reference now to FIG. 3, the ultrasonic vibration system 61 in one embodiment suitably comprises an ultrasonic horn, generally indicated at 71, having a terminal end 73 that in the illustrated embodiment defines the terminal end 65 of the vibration system, and more particularly defines the contact surface 63 of the vibration system. In particular, the ultrasonic horn 71 of FIG. 3 is suitably configured as what is referred to herein as an ultrasonic bar (also sometimes referred to as a blade horn) in which the terminal end 73 of the horn is generally elongate, e.g., along its width w. The ultrasonic horn 71 in one embodiment is suitably of unitary construction such that the contact surface 63 defined by the terminal end 73 of the horn is continuous across the entire width w of the horn.

Additionally, the terminal end 73 of the horn 71 is suitably configured so that the contact surface 63 defined by the terminal end of the ultrasonic horn is generally flat and rectangular. It is understood, however, that the horn 71 may be configured so that the contact surface 63 defined by the terminal end 73 of the horn is more rounded or other than flat without departing from the scope of this invention. The ultrasonic horn 71 is suitably oriented relative to the moving textile web 23 so that the terminal end 73 of the horn extends in the cross-machine direction across the width of the web. The width w of the horn 71, at least at its terminal end 73, is suitably sized approximately equal to and may even be greater than the width of the web.

Figure 4:
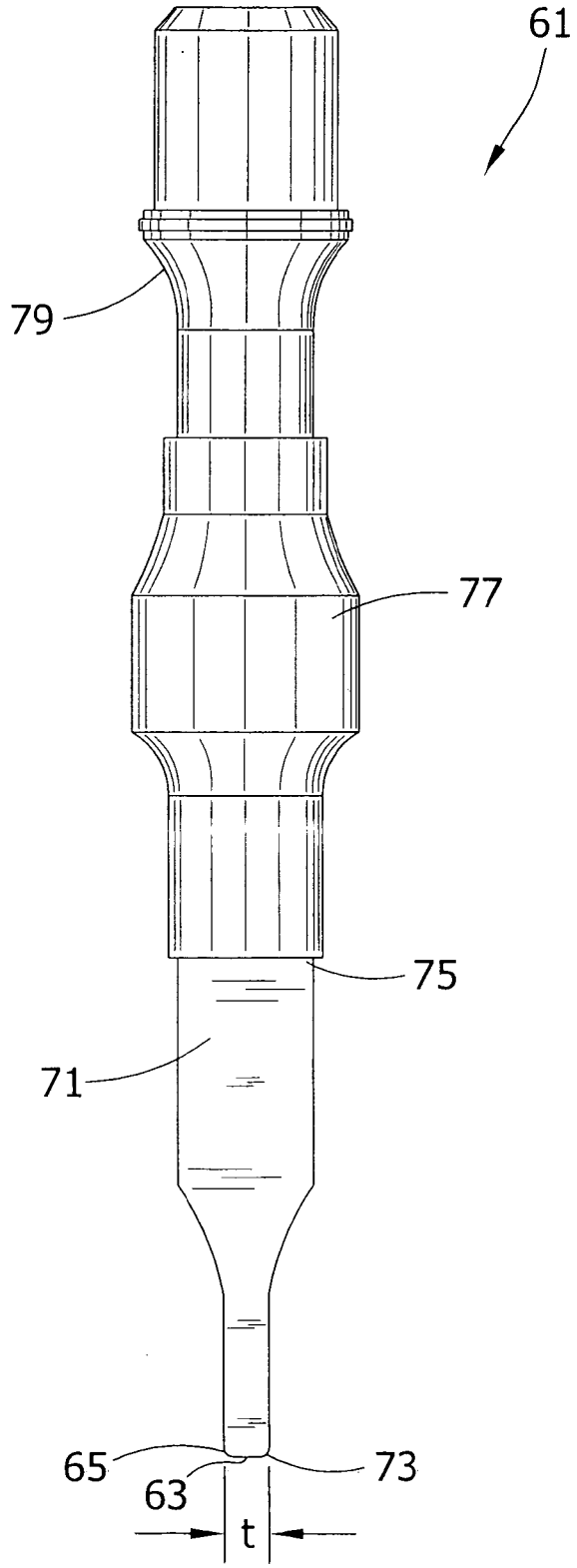
FIG. 4 is a side elevation thereof.

A thickness t (FIG. 4) of the ultrasonic horn 71 is suitably greater at a connection end 75 of the horn (i.e., the longitudinal end of the horn opposite the terminal end 73 thereof) than at the terminal end of the horn to facilitate increased vibratory displacement of the terminal end of the horn during ultrasonic vibration. As one example, the ultrasonic horn 71 of the illustrated embodiment of FIGS. 3 and 4 has a thickness t at its connection end 75 of approximately 1.5 inches (3.81 cm) while its thickness at the terminal end 73 is approximately 0.5 inches (1.27 cm). The illustrated horn 71 also has a width w of about 6.0 inches (15.24 cm) and a length (e.g., height in the illustrated embodiment) of about 5.5 inches (13.97 cm). The thickness t of the illustrated ultrasonic horn 71 tapers inward as the horn extends longitudinally toward the terminal end 73. It is understood, however, that the horn 71 may be configured other than as illustrated in FIGS. 3 and 4 and remain within the scope of this invention as long as the horn defines a contact surface 63 of the vibration system 61 suitable for contacting the textile web 23 to impart ultrasonic energy to the web.

The ultrasonic vibration system 61 of the illustrated embodiment is suitably in the form of what is commonly referred to as a stack, comprising the ultrasonic horn, a booster 77 coaxially aligned (e.g., longitudinally) with and connected at one end to the ultrasonic horn 71 at the connection end 75 of the horn, and a converter 79 (also sometimes referred to as a transducer) coaxially aligned with and connected to the opposite end of the booster. The converter 79 is in electrical communication with a power source or generator (not shown) to receive electrical energy from the power source and convert the electrical energy to high frequency mechanical vibration. For example, one suitable type of converter 79 relies on piezoelectric material to convert the electrical energy to mechanical vibration.

The booster 77 is configured to amplify (although it may instead be configured to reduce, if desired) the amplitude of the mechanical vibration imparted by the converter 79. The amplified vibration is then imparted to the ultrasonic horn 71. It is understood that the booster 77 may instead be omitted from the ultrasonic vibration system 61 without departing from the scope of this invention. Construction and operation of a suitable power source, converter 79 and booster 77 are known to those skilled in the art and need not be further described herein.

In one embodiment, the ultrasonic vibration system 61 is operable (e.g., by the power source) at a frequency in the range of about 15 kHz to about 100 kHz, more suitably in the range of about 15 kHz to about 60 kHz, and even more suitably in the range of about 20 kHz to about 40 kHz. The amplitude (e.g., displacement) of the horn 71, and more particularly the terminal end 73 thereof, upon ultrasonic vibration may be varied by adjusting the input power of the power source, with the amplitude generally increasing with increased input power. For example, in one suitable embodiment the input power is in the range of about 0.1 kW to about 4 kW, more suitably in the range of about 0.5 kW to about 2 kW and more suitably about 1 kW.

In operation according to one embodiment of a process for dyeing a textile web, a rolled textile web 23 is initially unwound from an unwind roll 45, e.g., by the wind roll 49 and drive mechanism 51, with the web passing the dye applicator 25 and the ultrasonic vibration system 61. The ultrasonic vibration system 61 is in its second position (as illustrated in FIGS. 1 and 2) with the terminal end 65 (and hence the contact surface 63) of the vibration system displaced along with the textile web to the desired approach and departure angles A1, B1 of the textile web. The textile web 23 may also be tensioned in the second position of the vibration system 61 and/or by further winding the wind roll 49, by back winding the unwind roll 45, by both, or by other suitable tensioning structure and/or techniques.

During processing between the unwind roll 45 and the wind roll 49, the textile web 23 is suitably configured in what is referred to herein as a generally open configuration as the web passes over the contact surface 63 of the ultrasonic vibration system 61. The term "open configuration" is intended to mean that the textile web 23 is generally flat or otherwise unfolded, ungathered and untwisted, at least at the segment of the web in contact with the contact surface 63 of the vibration system 61.

A feed rate of the web 23 (i.e., the rate at which the web moves in the machine direction over the contact surface 63 of the vibration system 61) and the width of the contact surface (i.e., the thickness t of the terminal end 73 of the horn 71 in the illustrated embodiment, or where the contact surface is not flat or planar, the total length of the contact surface from one side of the terminal end of the horn to the opposite side thereof) determine what is referred to herein as the dwell time of the web on the contact surface of the vibration system. It will be understood, then, that the term "dwell time" refers herein to the length of time that a segment of the textile web 23 is in contact with the contact surface 63 of the vibration system 61 as the web is drawn over the contact surface (e.g., the width of the contact surface divided by the feed rate of the web). In one suitable embodiment, the feed rate of the web 23 across the contact surface 63 of the vibration system 61 is in the range of about 0.5 feet/minute to about 2,000 feet/minute, more suitably in the range of about 1 feet/minute to about 100 feet/minute and even more suitably in the range of about 2 feet/minute to about 10 feet/minute. It is understood, however, that the feed rate may be other than as set forth above without departing from the scope of this invention.

In other embodiments, the dwell time is suitably in the range of about 0.1 second to about 60 seconds, more suitably in the range of about 1 second to about 10 seconds, and even more suitably in the range of about 2 seconds to about 5 seconds. It is understood, however, that the dwell time may be other than as set forth above depending for example on the material from which the web 23 is made, the dye composition, the frequency and vibratory amplitude of the horn 71 of the vibration system 61 and/or other factors, without departing from the scope of this invention.

As the textile web 23 passes the dye applicating device 25, dye is applied to the one face 24*a* of the web. The ultrasonic vibration system 61 is operated by the power source to ultrasonically vibrate the ultrasonic horn 71 as the opposite face 24*b* of the textile web 23 is drawn over the contact surface 63 of the vibration system. The horn 71 imparts ultrasonic energy to the segment of the textile web 23 that is in contact with the contact surface 63 defined by the terminal end 73 of the horn. Imparting ultrasonic energy to the opposite face 24*b* of the textile web 23 facilitates the migration of dye from the one face 24*a* of the web into and through the web to the opposite face 24*b* of the web. The ultrasonic energy also heats the dye, causing some of the solvent (e.g., water or organic solvent) in the dye to evaporate and thereby initiate binding of the dye to the web 23.

It is understood, however, that the face 24*a* (i.e., the face on which the dye is applied) of the textile web 23 may oppose and contact the contact surface 63 of the vibration system 61 without departing from the scope of this invention. It is also contemplated that a second ultrasonic vibration system (not shown) may be used to apply ultrasonic energy to the face 24*a* of the web, either concurrently or sequentially with the first ultrasonic vibration system 61 applying ultrasonic energy to the opposite face 24*b* of the web.

Experiment 1

An experiment was conducted to assess the effectiveness of apparatus constructed in the manner of the apparatus 21 of the embodiment of FIGS. 1 and 2 in dyeing a textile web 23, and more particularly the effectiveness of the ultrasonic vibration system 61 to pull dye applied to one face 24*a* of the web through the web to the opposite face 24*b* of the web. For this experiment, a cotton web commercially available from Test Fabrics, Inc. of West Pittston, Pa., U.S.A. as Style No. 419—bleached, mercerized, combed broadcloth was used as the textile web. The web had a basis weight of about 120 grams per square meter and a weight of about 15.53 grams. The web specimen was approximately four feet (about 122 cm) in length and four inches (about 10.2 cm) wide.

A red dye solution was formed from 10.1 grams of red dichlorotriazine dye (typically referred to as a fiber-reactive dye), commercially available from DyStar Textilfarben GmbH of Germany under the tradename and model number Procion MX-5B, 10.2 grams of sodium carbonate and 1000 grams of water. The dye solution was loaded into a conventional hand-held spray bottle (e.g., such as the type used to spray glass cleaner) for applying the dye solution to the web specimen.

For the ultrasonic vibration system, the various components that were used are commercially available from Dukane Ultrasonics of St. Charles, Ill., U.S.A as the following model numbers: power supply—Model 20A3000; converter—Model 110-3123; booster—Model 2179T; and horn Model 11608A. In particular, the horn had a thickness at its connection end of approximately 1.5 inches (3.81 cm), a thickness at its terminal end of approximately 0.5 inches (1.27 cm), a width of about 6.0 inches (15.24 cm) and a length (e.g., height in the illustrated embodiment) of about 5.5 inches (13.97 cm). The contact surface defined by the terminal end of the horn was flat, resulting in a contact surface length (e.g., approximately equal to the thickness of the horn at its terminal end) of about 0.5 inches (1.27 cm).

To conduct the experiment, the web was drawn past the ultrasonic vibration system in an open configuration at a feed rate of about 4 ft./min. (about 2.03 cm/sec). Before the web reached the ultrasonic vibration system, the dye was manually sprayed onto the face of the web that faces away from the ultrasonic vibration system, e.g., with repeated manual pumping of the spray bottle so as to approximate a uniform application of dye of about 30 grams/square meter of web. The opposite face of the web (i.e., the face that is opposite that on which the dye was sprayed) was then drawn over the contact surface of the ultrasonic vibration system (e.g., in direct contact therewith). This resulted in a dwell time of the web on the contact surface of the ultrasonic vibration system of about 0.63 seconds. A uniform tension of approximately 1 pound per inch of web width was applied to the web (e.g., by holding the web taught during drawing of the web). The approach and departure angles of the web relative to the longitudinal axis of the ultrasonic vibration system were each about 20 degrees.

Along an initial segment (e.g., about one-half) of the textile web, the ultrasonic vibration system was inoperative as the initial segment passed over the contact surface of the ultrasonic vibration system. The ultrasonic vibration system was then operated at about 1 kW and vibrated at about 20 kHz as a subsequent segment of the textile web passed over the contact surface of the vibration system.

Figure 5:
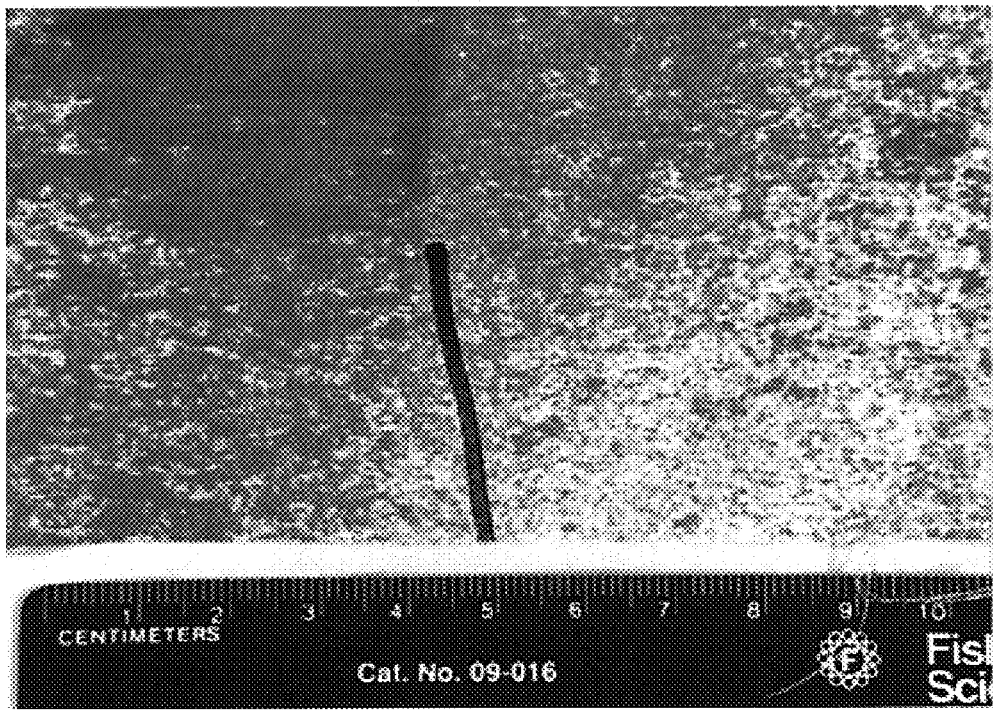
FIG. 5 is a photograph of a textile web following testing according to an Experiment described herein.
Figure 6:
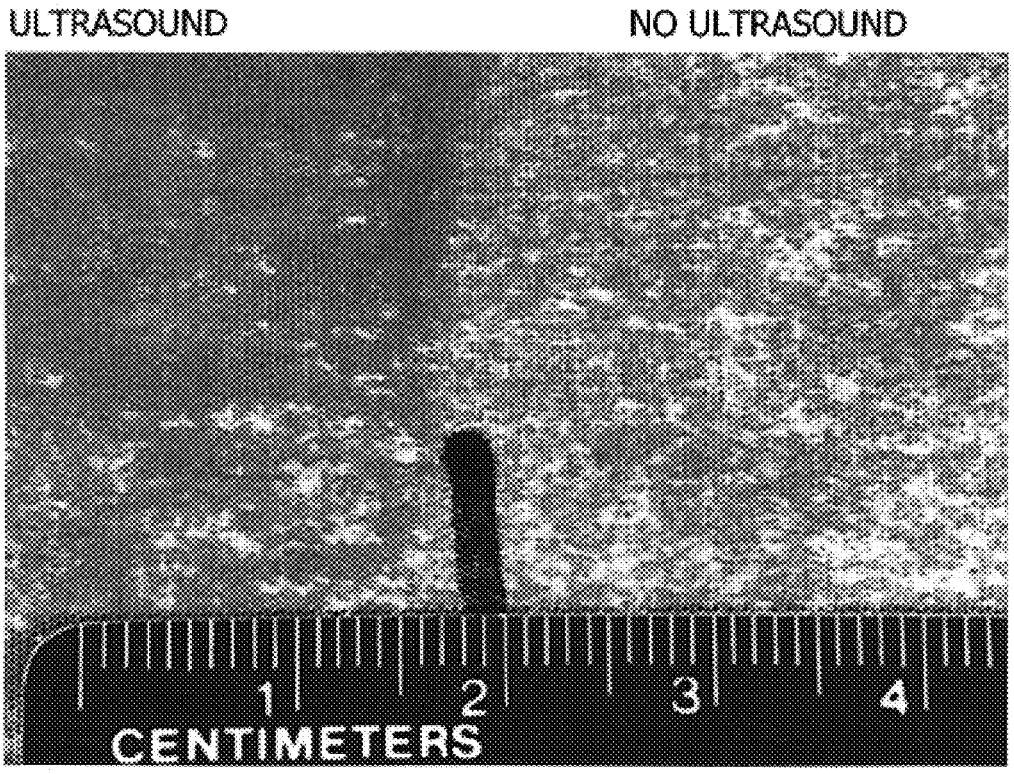
FIG. 6 is a photograph of an enlarged portion of the photograph of FIG. 5.

The photographs provided in FIGS. 5 and 6 show the face (e.g., face 24*b*) of the web opposite to the face (e.g., face 24*a*) on which the dye was initially sprayed generally at the transition zone (marked by the black line drawn on the web) at which the ultrasonic vibration system was transitioned from being inoperative to operative. The segment that was untreated by ultrasonic energy is on the right hand side and the segment that was ultrasonically treated is on the left hand side. There is a noticeable color intensity difference between the non-treated and the ultrasonically treated segments, thus indicating that the application of ultrasonic energy to the opposite face 24*b* of the textile web facilitates increased or improved distribution (e.g., drawing or pulling of the dye) from the face of the web to which the dye was applied into and through the web to the opposite face thereof.

Experiment 2

Another experiment was conducted to assess the effectiveness of apparatus constructed in the manner of the apparatus 21 of the embodiment of FIGS. 1 and 2 in binding dye to the textile web 23 during operation.

For this experiment, a polyester web commercially available from Test Fabrics, Inc. of West Pittston, Pa., U.S.A. as Style No. 700-13 polyester Georgette was used as the textile web. The web had a basis weight of about 58 grams per square meter, was approximately four feet (about 122 cm) in length and four inches (about 10.2 cm) wide. This particular web material was used for its ability to allow dye to readily penetrate through the web upon application of the dye thereto without the need for the ultrasonic vibration system 61 to facilitate migration of the dye through the web.

A water-based dye commercially available from Yuhan-Kimberly of South Korea as model designation 67581-11005579 NanoColorant Cyan 220 ml was used as the dye. The dye did not comprise the high thermal conductivity component described previously herein. The dye solution was loaded into a conventional hand-held spray bottle (e.g., such as the type used to spray glass cleaner) for applying the dye solution to the web specimen.

The ultrasonic vibration system was the same system used for Experiment 1 above.

To conduct the experiment, the web was drawn past the ultrasonic vibration system in an open configuration at a feed rate of about 4 ft./min. (about 2.03 cm/sec). Before the web reached the ultrasonic vibration system, the dye was manually sprayed onto the face of the web that faces away from the ultrasonic vibration system, e.g., with repeated manual pumping of the spray bottle so as to approximate a uniform application of dye of about 30 grams/square meter of web. The opposite face of the web (i.e., the face that is opposite that on which the dye was sprayed) was then drawn over the contact surface of the ultrasonic vibration system (e.g., in direct contact therewith). This resulted in a dwell time of the web on the contact surface of the ultrasonic vibration system of about 0.63 seconds. A uniform tension of approximately 1 pound per inch of web width was applied to the web (e.g., by holding the web taught during drawing of the web). The approach and departure angles of the web relative to the longitudinal axis of the ultrasonic vibration system were each about 20 degrees.

Along an initial segment (e.g., about one-half) of the textile web, the ultrasonic vibration system was inoperative as the initial segment passed over the contact surface of the ultrasonic vibration system. The ultrasonic vibration system was then operated at about 1 kW and vibrated at about 20 kHz as a subsequent segment of the textile web passed over the contact surface of the vibration system.

The web was then unrolled and a visual inspection of the web indicated that the dye was generally uniformly distributed to both faces of the web, both along the portion of the web to which ultrasonic vibration was not applied and along the portion of the web to which ultrasonic vibration was applied. The web was then hand-washed in a one gallon bath of detergent solution comprised of 99.9% by volume of water and 0.1% by volume detergent (available from Procter and Gamble of Cincinnati, Ohio under the tradename Joy) to remove unbound dye from the web. The bath was intermittently dumped and refilled with a clean detergent solution until little or no dye washed out of the web.

Figure 7:
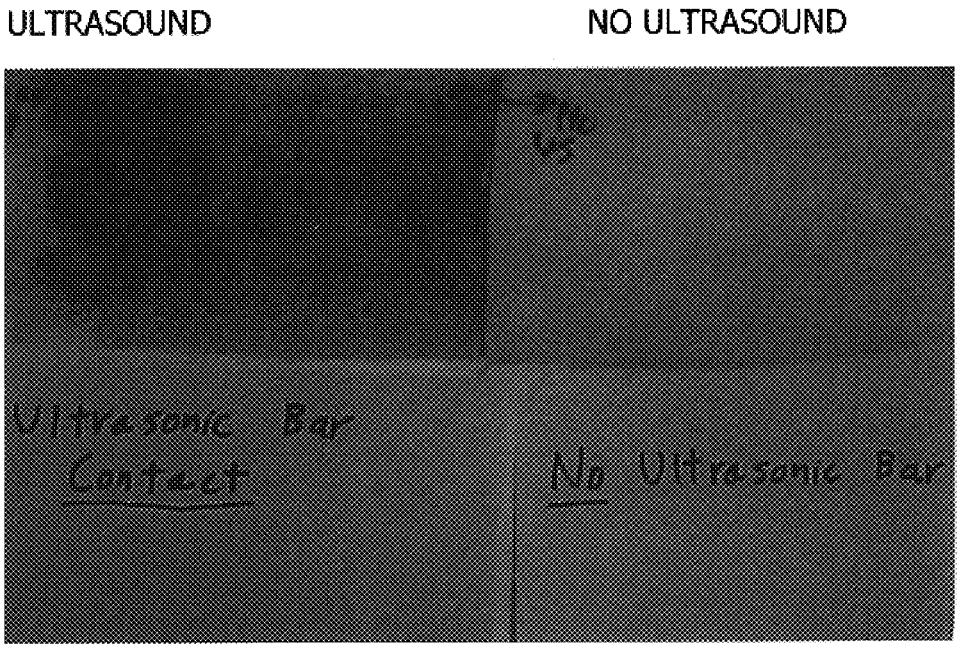
FIG. 7 is a photograph of a textile web following testing according to another Experiment described herein.
Figure 8:
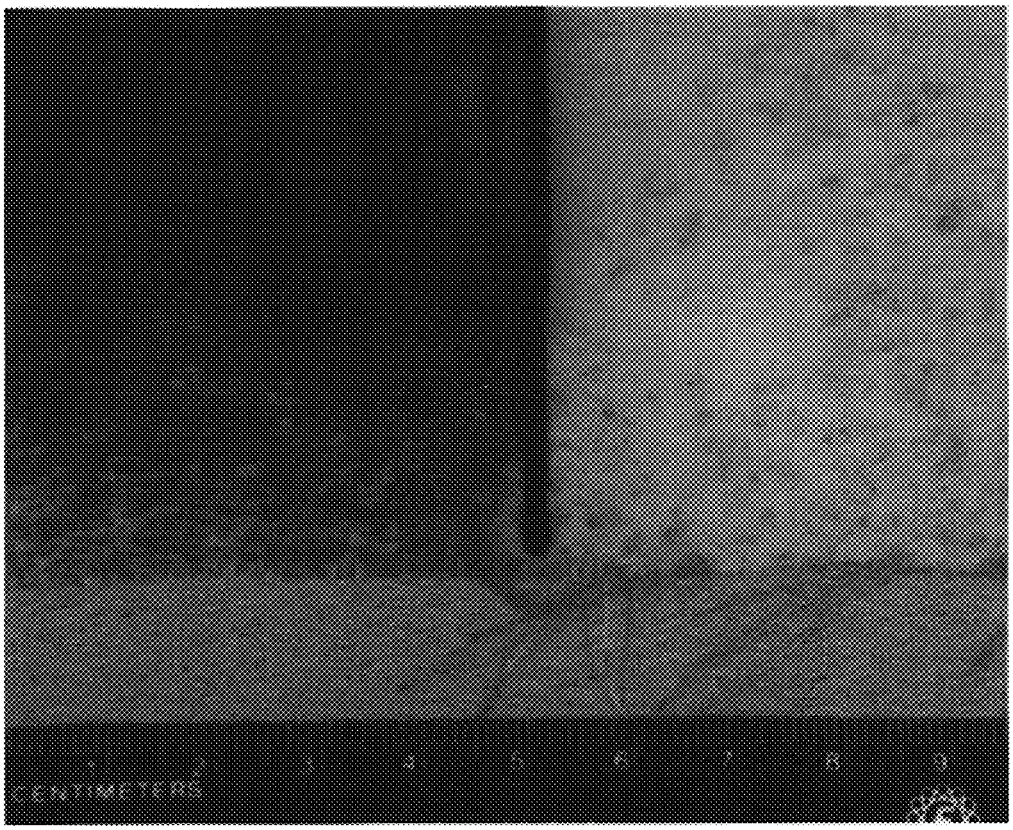
FIG. 8 is a photograph of an enlarged portion of the photograph of FIG. 7.

FIGS. 7 and 8 are photographs taken of the face of the web opposite to the face on which the dye was initially sprayed. The photographs were taken generally at the transition zone (marked by the black line drawn on the web) at which the ultrasonic vibration system was transitioned from being inoperative to operative. The segment that was untreated by ultrasonic energy is on the right hand side and the segment that was ultrasonically treated is on the left hand side. As is readily seen from the photographs, much of the dye was washed out from the segment of the web to which no ultrasonic energy was applied. Thus, absent further processing the dye is not bound to the web after application of the dye thereto. Surprisingly, for the segment subjected to ultrasonic energy a fair amount of the dye was bound to the web as a result of the ultrasonic energy. However, some areas of this segment also indicate washing away of unbound dye. The binding in this instance occurred without adding a highly thermally conductive component to the dye. It is believed that adding such a component to the dye will further expedite and enhance the binding of the dye to the web upon application of ultrasonic energy directly to the web after dye is applied to the web.

Following the application of ultrasonic energy to the textile web 23, additional post-processing may be performed, either at a station located between the ultrasonic vibration system 61 and the wind roll 49 or at a separate station altogether. Examples of suitable post-processing steps include heat treating or other curing steps to enhance binding of the dye within the textile web, and washing the web to remove unbound dye that remains within the web. In a particularly suitable washing process, the textile web may be passed through a bath of cleaning solution in direct contact with an ultrasonic vibration system having a contact surface immersed in the cleaning solution. The ultrasonic energy in contact with the web facilitates drawing unbound dye to the faces of the web for entrainment in the cleaning solution. More suitably, the cleaning solution may flow relative to the web to carry away unbound dye removed from the web. One suitable example of such a washing system is described in a co-pending application entitled PROCESS FOR DYEING A TEXTILE WEB, application Ser. No. 11/617,523, filed Dec. 28, 2006, the entire disclosure of which is incorporated herein by reference.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A process for dyeing a textile web, said textile web having a first face and a second face opposite the first face, said process comprising:

applying dye directly to the first face of the textile web other than by saturating the web and not to the second face;

moving the web in an open configuration thereof over a contact surface of an ultrasonic vibration system with the second face of the textile web in direct contact with the contact surface of the ultrasonic vibration system and the first face being free from contact with the contact surface of the ultrasonic vibration system; and operating the ultrasonic vibration system to impart ultrasonic energy to said second face of the textile web to facilitate movement of the dye from the first face of the web into and through the web to the second face thereof.

2. The process set forth in claim 1 wherein the ultrasonic vibration system has a longitudinal axis, the textile web being moved in a machine direction from a location upstream from the contact surface of the ultrasonic vibration system to a location at which the second face of the textile web is in contact with the contact surface of the ultrasonic vibration system, said movement of the web in the machine direction being along an approach angle relative to said longitudinal axis of the ultrasonic vibration system, said approach angle being in the range of about 1 to about 89 degrees.

3. The process set forth in claim 2 wherein the approach angle is in the range of about 10 to about 45 degrees.

4. The process set forth in claim 2 wherein the textile web is further moved in the machine direction along a departure angle relative to the longitudinal axis of the ultrasonic vibration system from said contact of the second face of the web with the contact surface of the ultrasonic vibration system to a location downstream from said contact surface of the ultrasonic vibration system, said departure angle being in the range of about 1 to about 89 degrees.

5. The process set forth in claim 4 wherein the departure angle is substantially equal to the approach angle.

6. The process set forth in claim 1 wherein the ultrasonic vibration system has a longitudinal axis, the textile web being moved in a machine direction from a location in which the second face of the web is in contact with the contact surface of the ultrasonic vibration system to a location downstream of said contact surface of the ultrasonic vibration system, the movement of the web in the machine direction defining a departure angle of the web relative to the longitudinal axis of the ultrasonic vibration system in the range of about 1 to about 89 degrees.

7. The process set forth in claim 1 wherein the textile web has a width, the process further comprising holding the textile web in uniform tension across the width of the textile web at least at a portion of said textile web in direct contact with the contact surface of the ultrasonic vibration system, said tension being in the range of about 0.025 to about 3 pounds per inch of width of the textile web.

8. The process set forth in claim 1 wherein the ultrasonic vibration system is vibrated at a frequency in the range of about 20 kHz to about 40 kHz.

9. The process set forth in claim 1 wherein the ultrasonic vibration system has a displacement amplitude at the contact surface upon vibration thereof, said amplitude being in the range of about 0.0005 to about 0.007 inches.

10. The process set forth in claim 1 wherein the step of operating the ultrasonic vibration system comprises supplying a power input to said system, the power input being in the range of about 0.5 kW to about 2 kw.

11. The process set forth in claim 1 wherein the textile web has a width, the ultrasonic vibration system comprising an ultrasonic horn having a terminal end defining said contact surface, said terminal end of the ultrasonic horn having a width that is approximately equal to or greater than the width of the web, the step of moving the web in an open configuration thereof over the contact surface of an ultrasonic vibration system comprising moving the web lengthwise over the contact surface of the ultrasonic vibration system with the terminal end of the ultrasonic vibration system oriented to extend widthwise across the width of the web with the contact surface in direct contact with the web.

12. The process set forth in claim 11 wherein the ultrasonic horn is of unitary construction to extend continuously at least along its width at said terminal end of the ultrasonic horn.

13. The process set forth in claim 1 wherein the step of applying dye directly to the first face of the web comprises applying dye having a viscosity in the range of about 2 centipoises to about 100 centipoises to the first face of the web.

14. The process set forth in claim 13 wherein the step of applying dye directly to the first face of the web comprises applying dye having a viscosity in the range of about 2 centipoises to about 20 centipoises to the first face of the web.

15. The process set forth in claim 1 wherein the step of applying dye directly to the first face of the web comprises applying dye to the first face of a web having a porosity in the range of about 10 to about 90 percent.

16. The process set forth in claim 15 wherein the step of applying dye directly to the first face of the web comprises applying dye to the first face of a web having a porosity in the range of about 20 to about 90 percent.

17. The process set forth in claim 1 wherein the dye is applied directly to the first face of the textile web using a dye applicating device that does not contact the first face.

18. The process set forth in claim 1 wherein the dye is applied directly to the first face of the textile web before the ultrasonic energy is imparted to the second face of the textile web.

19. The process set forth in claim 1 wherein moving the web in an open configuration thereof over a contact surface of an ultrasonic vibration system comprises directly contacting a segment of the second face of the textile with the contact surface of the ultrasonic vibration system for a length of time in the range of about 0.1 second to about 60 seconds.

20. The process set forth in claim 19 wherein the length of time that the segment of the second face of the textile is in contact with the contact surface of the ultrasonic is in the range of about 1 second to about 10 seconds.

21. The process set forth in claim 20 wherein the length of time that the segment of the second face of the textile is in contact with the contact surface of the ultrasonic is in the range of about 2 second to about 5 seconds.

22. A process for dyeing a textile web, said process comprising:

moving a textile web having a first face and a second face opposite the first face past a dye applicating device;

operating the dye applicating device to apply dye to the first face of the textile web without applying said dye to the second face of the textile web;

moving the dyed textile web in an open configuration thereof over a contact surface of an ultrasonic vibration system with the second face of the textile web in direct contact with the contact surface of the ultrasonic vibration system and the first face being free from contact with the contact surface of the ultrasonic vibration system; and operating the ultrasonic vibration system to impart ultrasonic energy to said second face of the textile web to facilitate movement of the dye from the first face of the web into and through the web to the second face thereof.

23. The process set forth in claim 22 wherein the textile web has a width, the process further comprising holding the textile web in uniform tension across the width of the textile web at least at a portion of said textile web in direct contact with the contact surface of the ultrasonic vibration system, said tension being in the range of about 0.025 to about 3 pounds per inch of width of the textile web.

24. The process set forth in claim 22 wherein the ultrasonic vibration system is vibrated at a frequency in the range of about 20 kHz to about 40 kHz.

25. The process set forth in claim 22 wherein the step of operating the ultrasonic vibration system comprises supplying a power input to said system, the power input being in the range of about 0.5 kW to about 2 kw.

26. The process set forth in claim 22 wherein the textile web has a width, the ultrasonic vibration system comprising an ultrasonic horn having a terminal end defining said contact surface, said terminal end of the ultrasonic horn having a width that is approximately equal to or greater than the width of the web, the step of moving the web in an open configuration thereof over the contact surface of an ultrasonic vibration system comprising moving the web lengthwise over the contact surface of the ultrasonic vibration system with the terminal end of the ultrasonic vibration system oriented to extend widthwise across the width of the web with the contact surface in direct contact with the web.

27. The process set forth in claim 22 wherein the step of operating the dye applicating device comprises operating a dye application device to apply a dye having a viscosity in the range of about 2 centipoises to about 100 centipoises to the first face of the textile web.

28. The process set forth in claim 26 wherein the step of operating the dye applicating device comprises operating a dye application device to apply a dye having a viscosity in the range of about 2 centipoises to about 20 centipoises to the first face of the textile web.

29. The process set forth in claim 22 wherein the step of moving a textile web past a dye applicating device comprises moving a woven textile web past the dye application device.

30. The process set forth in claim 22 wherein the step of moving a textile web past a dye applicating device comprises moving a textile web having a porosity in the range of about 10 to about 90 percent past the dye applicating device.

31. The process set forth in claim 22 wherein the dye applicating device does not contact the first face of the textile web.

32. The process set forth in claim 22 wherein the dye is applied to the first face of the textile web before the ultrasonic energy is imparted to the second face of the textile web.

* * * * *